United States Patent [19]

Kramer

[11] Patent Number: 4,872,833

[45] Date of Patent: Oct. 10, 1989

[54] GAS BURNER CONSTRUCTION

[75] Inventor: David W. Kramer, Milwaukee, Wis.

[73] Assignee: A. O. Smith Corporation, Milwaukee, Wis.

[21] Appl. No.: 194,976

[22] Filed: May 16, 1988

[51] Int. Cl.[4] ..... F23D 14/62

[52] U.S. Cl. ..... 431/354; 431/346

[58] Field of Search ..... 431/354, 350, 346, 353, 431/347, 8; 239/399

[56] References Cited

U.S. PATENT DOCUMENTS

| | | | |
|---|---|---|---|
| 850,996 | 4/1907 | Cooley . | |
| 959,583 | 5/1910 | Peterson et al. . | |
| 1,071,053 | 8/1913 | Hunter . | |
| 1,109,272 | 9/1914 | Wierum | 239/399 |
| 1,360,961 | 11/1920 | Witt . | |
| 1,384,598 | 7/1921 | Butts | 431/354 |
| 1,464,909 | 8/1923 | Kimberlin | 431/350 |
| 1,510,060 | 9/1924 | Hoover et al. . | |
| 1,618,471 | 8/1931 | Geauque . | |
| 3,259,170 | 7/1966 | Koehrer | 431/350 |
| 4,255,125 | 3/1981 | Auclair | 431/354 |
| 4,639,215 | 1/1987 | Armstrong | 431/354 |

FOREIGN PATENT DOCUMENTS

| | | | |
|---|---|---|---|
| 158588 | 3/1904 | Fed. Rep. of Germany | 239/399 |
| 87937 | 10/1985 | Fed. Rep. of Germany | 239/399 |
| 166777 | 4/1981 | Netherlands | 431/354 |
| 8284 | 3/1913 | United Kingdom | 239/399 |
| 1499213 | 1/1978 | United Kingdom | 431/354 |

*Primary Examiner*—Margaret A. Focarino

*Attorney, Agent, or Firm*—Andrus, Sceales, Starke & Sawall

[57] ABSTRACT

An improved gas burner construction comprising a gas supply conduit having an outlet. A venturi is located downstream of the outlet and includes a converging section, a throat section, and a diverging section. The converging section of the venturi is spaced outwardly of the gas outlet to provide an annular passage through which air is drawn into the venturi. A helical baffle is disposed within the diverging section of the venturi and is spaced downstream of the throat section. The upstream end of the baffle is secured to the diverging section and the remaining portion of the baffle extending downstream from the upstream end has a substantially uniform diameter and is spaced inwardly from the diverging section of the venturi. A target is mounted on the downstream end of the diverging section of the venturi and includes a central disc-like portion, which spreads the combustible gas-air mixture and provides a short flame pattern.

10 Claims, 1 Drawing Sheet

GAS BURNER CONSTRUCTION

BACKGROUND OF THE INVENTION

In atmospheric-type gas burners, as used in a combustion apparatus such as a furnace, air is drawn into the mixing chamber by the aspirating action of the gas flow and is mixed with the gas to provide a combustible gas-air mixture. It is important to provide uniform mixing of the gas and air to obtain the optimum combustion characteristics and in the past, various types of mixing devices, such as vanes, fans, baffles, and the like have been used to achieve the desired mixing of the gas and air.

It is also known to utilize a target at the downstream end of the mixing chamber. The conventional target takes the form of a screen or disc that partially closes off the downstream end of the mixing chamber and generates a back pressure and spreads the combustion mixture to provide a short axial flame pattern.

SUMMARY OF THE INVENTION

The invention is directed to an improved gas burner construction, and more particularly to a short axial-length burner having improved mixing characteristics.

In accordance with the invention, the burner comprises a gas supply conduit having an outlet, and a venturi is located downstream of the outlet and includes a converging section, an intermediate throat section, and a diverging section. The converging section of the venturi is spaced radially outward of the gas outlet to provide an annular passage through which air is drawn into the venturi by the aspirating action of the gas being discharged through the outlet.

Located within the diverging section of the venturi is a helical baffle, which is spaced downstream from the throat section. The upstream end of the baffle is secured to the diverging section of the venturi, while the remaining portion of the baffle, extending downstream from the upstream end, has a substantially uniform diameter and is spaced radially inward from the diverging section, so that it is unsupported.

As the gas and air pass through the venturi, the velocity is increased and the helical baffle increases the turbulence to provide an effective mixing action.

A target, which is located at the downstream end of the venturi, generates burner back pressure, as well as spreading the combustible mixture radially and providing a short flame pattern.

The burner of the invention is an atmospheric type which provides improved mixing of the gas and air in a short axial length to provide an increased efficiency of combustion.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
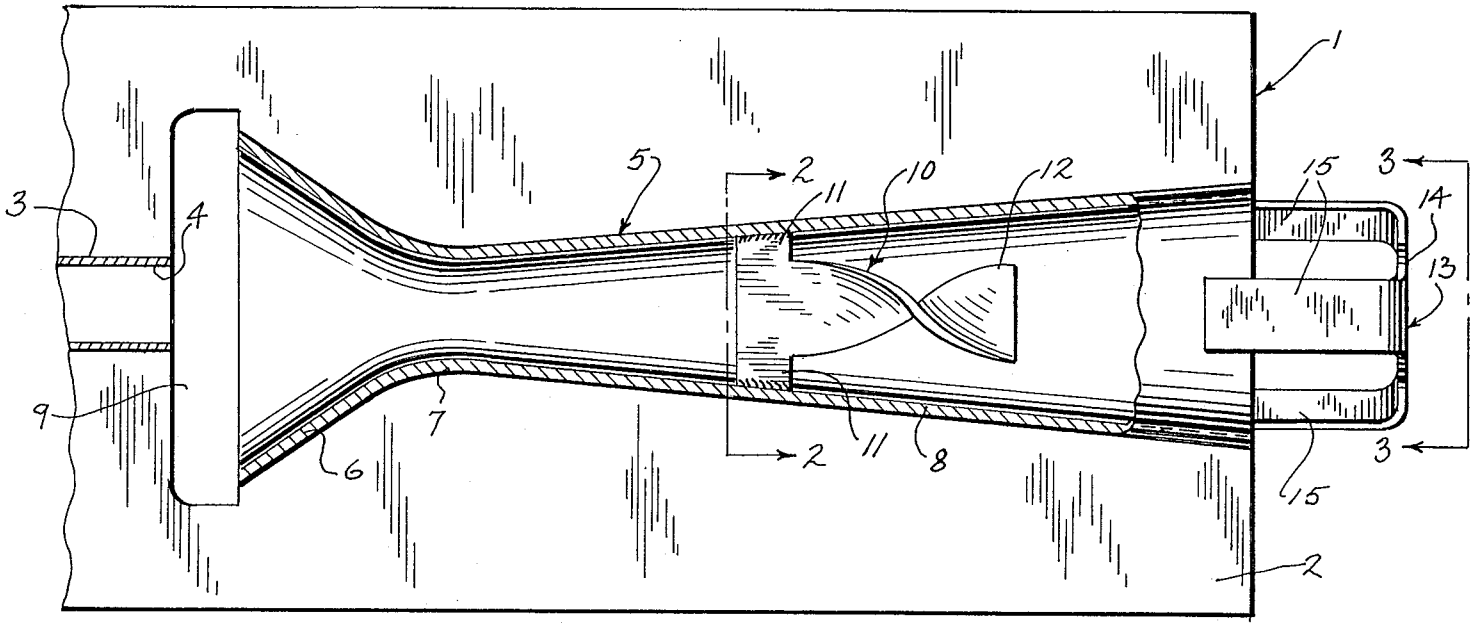
FIG. 1 is a side elevation of the burner of the invention with parts broken away in section.

The drawings illustrate a short flame atmospheric burner 1 to be used in a combustion apparatus, such as a furnace, or the like. Burner 1 includes a generally flat mounting plate 2, and a gas pipe 3, connected to a source of fuel gas under pressure, is secured within a slot in plate 2. The gas is discharged from pipe 3 through an outlet 4.

A venturi 5 is also secured within an opening in mounting plate 2 and is spaced downstream of the outlet 4. Venturi 5 includes a converging section 6, an intermediate throat section 7 and a diverging section 8.

As shown in FIG. 1, converging section 6 has a substantially greater diameter than the pipe 3, and is spaced radially outward from the outlet 4 to provide an annular passage 9, through which air is drawn into the venturi by the aspirating action of the gas being discharged form outlet 4.

Figure 2:
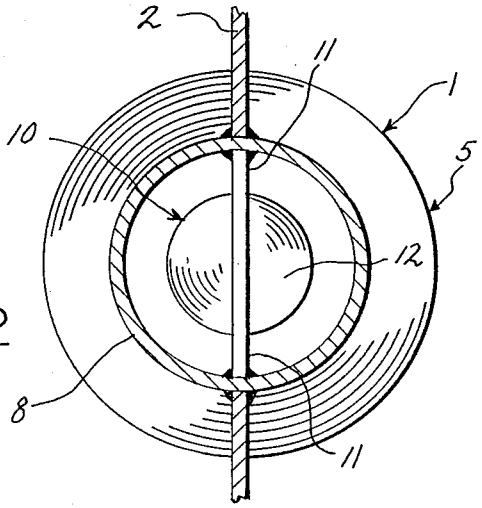
FIG. 2 is a section taken along line 2—2 of FIG. 1.
Figure 3:
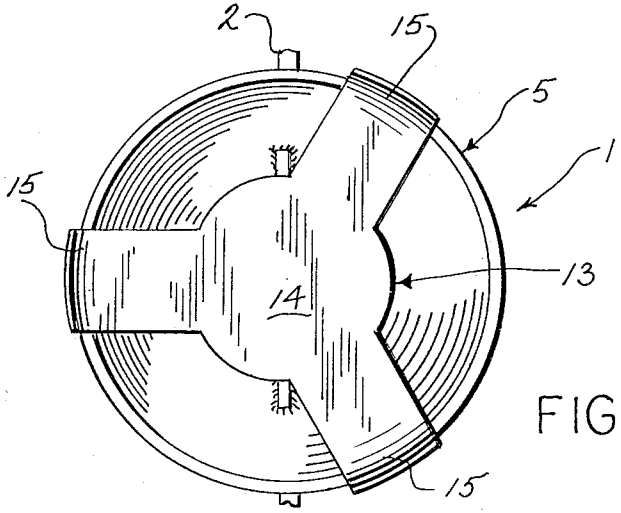
FIG. 3 is a section taken along line 2—2 of FIG. 1.

As an important aspect of the invention, a baffle 10 is secured within the diverging section 8 of venturi 5, and is spaced a substantial distance downstream from throat section 7. As shown in FIGS. 1 and 2, baffle 10 is provided with a pair of diametrically opposed ears 11, which are welded to the inner surface of diverging section 8. Baffle 10 also includes a helical section 12, which extends downstream from the upstream connecting section 11.

Baffle 10 is preferably made from steel or stainless steel and has a relatively heavy gauge, as opposed to the venturi 5. In practice, the baffle has been formed of stainless steel having a thickness of 0.60 inch, while the venturi is constructed of steel having a thickness of 0.30 inch.

The helical section 12 has a substantially uniform diameter throughout its length and is spaced from the wall of the diverging section 8, as shown in FIG. 1.

As illustrated, the baffle 10 extends only a small portion of the length of the diverging section 8 with the ends of the baffle being spaced approximately equidistant from the throat section 7 and the downstream end of diverging section 8, respectively, so that the baffle has an axial length approximately one-third of the length of the diverging section 8.

For a 30,000 to 50,000 BTU input burner, the helical section 12 of baffle 10 can have a twist of approximately 180° in one inch axial length.

Mounted at the downstream end of venturi 5 is a target 13, which is composed of a central disc-shaped portion 14 and a plurality of generally L-shaped legs 15, which connect the periphery of central portion 14 with the end of the venturi 5. As shown in FIG. 1, the disc-shaped section 14 is spaced outwardly of the downstream end of the venturi and has an area less than one-half the area of the downstream end of diverging section 8.

Target 13 acts to generate burner back pressure, as well as spreading the gas-air mixture radially outward to provide a short flame pattern.

A conventional igniter or pilot light, not shown, can be mounted on plate 2 adjacent the downstream end of venturi 5 to ignite the gas-air mixture.

In operation, the flow of gas through the outlet 4 will draw air by an aspirating action through the annular passage 9 and the velocity of the mixture will be increased as it passes through the throat section 7 into diverging section 8. Baffle 10 provides a swirling, turbulent flow for the mixture to increase the mixing action and the target acts to spread the combustible mixture radially outward and generate a short flame pattern. The burner of the invention provides improved mixing of the gas and air in a relatively short axial length to thereby improve the efficiency of operation.

Various modes of carrying out the invention are contemplated as being within the scope of the following claims particularly pointing out and distinctly claiming the subject matter which is regarded as the invention.

I claim:

1. A gas burner, comprising a conduit connected to a source of fuel gas and having an outlet, a venturi having a generally circular cross section and disposed downstream of said outlet and having a converging section spaced radially outward of said outlet to provide an annular air intake passage, said venturi also including an intermediate throat section disposed downstream of said converging section and a diverging section disposed downstream of said throat section, a baffle disposed in said venturi and having an upstream end secured to the inner surface of said diverging section at a location spaced downstream of said throat section, said baffle having a helical configuration and the portion of said baffle located downstream of said upstream end being spaced out of contact with the diverging section of said venturi, and target means spaced outwardly from the downstream end of said diverging section to spread the combustible mixture of gas and air and provide a relatively short flame pattern.

2. A gas burner construction, comprising a conduit connected to a source of gas fuel and having an outlet, a venturi having a generally circular cross section and disposed downstream of said outlet and including a converging section spaced radially outward of said outlet to provide an annular air intake passage, said venturi also including a throat section disposed downstream of said converging section and a diverging section disposed downstream of said throat section, baffle means disposed in said venturi and having an upstream end secured to the inner surface of said diverging section at a location spaced downstream of said throat section, said baffle means having a downstream end spaced a substantial distance from the downstream end of said diverging section, means for securing the upstream end of said baffle means to said diverging section, the portion of said baffle means extending downstream from said upstream end being generally helical in shape and having a substantially uniform diameter throughout its length and being spaced from the inner surface of said diverging section, and target means spaced longitudinally from the downstream end of said diverging section for spreading the mixture of gas and air and providing a relatively short flame pattern.

3. The gas burner construction of claim 2, wherein said portion of said baffle means is twisted approximately 180° per inch of axial length.

4. The gas burner construction of claim 2, wherein the length of said baffle means is approximately equal to one-third the length of said diverging section.

5. The gas burner construction of claim 4, wherein the longitudinal ends of said baffle means are spaced substantially equi-distant from the corresponding ends of said diverging section.

6. A gas burner, comprising a conduit connected to a source of fuel gas and having an outlet, a venturi disposed downstream of said outlet and having a converging section spaced radially outward of said outlet to provide an annular air intake passage, said venturi also including an intermediate throat section disposed downstream of said converging section and a diverging section disposed downstream of said throat section, a baffle disposed in said venturi and having an upstream end secured to the inner surface of said diverging section at a location spaced downstream of said throat section, said baffle having a helical configuration and the portion of said baffle located downstream of said upstream end being spaced out of contact with the diverging section of said venturi, and target means disposed across the downstream end of said diverging section to spread the combustible mixture of gas and air and provide a relatively short flame pattern, the upstream end of said baffle having a pair of opposed radially extending ears secured to said diverging section.

7. The gas burner of claim 6, wherein said portion of said baffle has a substantially uniform diameter throughout its length.

8. A gas burner, comprising a conduit connected to a source of fuel gas and having an outlet, a venturi disposed downstream of said outlet and having a converging section spaced radially outward of said outlet to provide an annular air intake passage, said venturi also including an intermediate throat section disposed downstream of said converging section and a diverging section disposed downstream of said throat section, a baffle disposed in said venturi and having an upstream end secured to the inner surface of said diverging section at a location spaced downstream of said throat section, said baffle having a helical configuration and the portion of said baffle located downstream of said upstream end being spaced out of contact with the diverging section of said venturi, and target means disposed across the downstream end of said diverging section to spread the combustible mixture of gas and air and provide a relatively short flame pattern, said target means including a central portion disposed substantially in axial alignment with said venturi and a plurality of legs connecting said central portion to said venturi.

9. The gas burner of claim 8, wherein said central portion is spaced longitudinally from the downstream end of said diverging section and said legs connect the periphery of said central portion with said downstream end.

10. A gas burner construction, comprising a conduit connected to a source of gas fuel and having an outlet, a venturi disposed downstream of said outlet and including a converging section spaced radially outward of said outlet to provide an annular air intake passage, said venturi also including a throat section disposed downstream of said converging section and a diverging section disposed downstream of said throat section, baffle means disposed in said venturi and having an upstream end secured to the inner surface of said diverging section at a location spaced downstream of said throat section, said baffle means having a downstream end spaced a substantial distance from the downstream end of said diverging section, means for securing the upstream end of said baffle means to said diverging section, the portion of said baffle means extending downstream from said upstream end being generally helical in shape and having a substantially uniform diameter throughout its length and being spaced from the inner surface of said diverging section, and target means spaced longitudinally from the downstream end of said diverging section for spreading the mixture of gas and air and providing a relatively short flame pattern, said baffle means and said venturi both being formed of metal with said baffle means having a heavier gauge than said venturi.

* * * * *